United States Patent [19]

Shimomura

[11] 4,034,368

[45] July 5, 1977

[54] NUMERICAL DISPLAY ELEMENT

[75] Inventor: Jun Shimomura, Tokyo, Japan

[73] Assignee: Nippon Kogaku K.K., Tokyo, Japan

[22] Filed: Jan. 20, 1976

[21] Appl. No.: 650,786

[30] Foreign Application Priority Data

Jan. 27, 1975 Japan ..... 50-12167[U]

[52] U.S. Cl. ..... 340/378 R; 340/336

[51] Int. Cl.[2] ..... G09F 9/32

[58] Field of Search ..... 340/336, 378 R; 313/510; 350/160 LC

[56] References Cited

UNITED STATES PATENTS

| | | | |
|---|---|---|---|
| 1,701,205 | 2/1929 | Glatzner | 340/336 |
| 3,781,863 | 12/1973 | Fujita | 350/160 LC |
| 3,831,166 | 8/1974 | DeNardo | 350/160 LC |

*Primary Examiner*—David L. Trafton

*Attorney, Agent, or Firm*—Shapiro and Shapiro

[57] ABSTRACT

In a numerical display element comprising seven segments, the horizontally extending central segment of the seven segments is divided into two parallel segments. On end of each of the two parallel segments is connected to an adjacent discrete segment. Thus, the numerical display element is formed by six segments.

2 Claims, 8 Drawing Figures

FIG. 2
PRIOR ART

| SEGMENTS / DISPLAYED NUMERALS | 1 | 2 | 3 | 4 | 5 | 6 | 7 |
|---|---|---|---|---|---|---|---|
| 1 | 0 | 0 | 1 | 0 | 0 | 0 | 1 |
| 2 | 1 | 0 | 1 | 1 | 1 | 1 | 0 |
| 3 | 1 | 0 | 1 | 1 | 0 | 1 | 1 |
| 4 | 0 | 1 | 1 | 1 | 0 | 0 | 1 |
| 5 | 1 | 1 | 0 | 1 | 0 | 1 | 1 |
| 6 | 1 | 1 | 0 | 1 | 1 | 1 | 1 |
| 7 | 1 | 0 | 1 | 0 | 0 | 0 | 1 |
| 8 | 1 | 1 | 1 | 1 | 1 | 1 | 1 |
| 9 | 1 | 1 | 1 | 1 | 0 | 1 | 1 |
| 0 | 1 | 1 | 1 | 0 | 1 | 1 | 1 |

FIG. 4

| SEGMENTS / DISPLAYED NUMERALS | 1 | 2 | 3 | 4 | 5 |
|---|---|---|---|---|---|
| 1 | 0 | 1 | 0 | 1 | 0 |
| 2 | 1 | 0 | 1 | 1 | 0 |
| 3 | 1 | 0 | 1 | 0 | 1 |
| 4 | 0 | 1 | 1 | 0 | 1 |
| 5 | 1 | 1 | 0 | 0 | 1 |
| 6 | 1 | 1 | 0 | 1 | 1 |
| 7 | 0 | 0 | 0 | 0 | 1 |
| 8 | 1 | 1 | 1 | 1 | 1 |
| 9 | 1 | 1 | 1 | 0 | 1 |
| 0 | 1 | 1 | 1 | 0 | 0 |

NUMERICAL DISPLAY ELEMENT

BACKGROUND OF THE INVENTION

1. Field of the Invention

This invention relates to improvements in a numerical display element comprising seven segments.

2. Description of the Prior Art

Numerical display elements each comprising seven elements are known and have been used as display means in various articles such as timepieces, photographic cameras, etc. Very conveniently, such numerical display elements are capable of displaying numerals from 0 to 9 by means of seven segments, but formation of a numerical display element by using a light-emitting diode or an electrooptical substance such as liquid srystal, dielectric crystal, electrochromic layer or the like requires two conductors to be used per segment. Even though the numerical display element is constructed in such a manner that one of the two conductors is common to all segments, one conductor per segment must be connected and thus, seven conductors in all must usually be led out of the segment. In articles such as timepieces or cameras which are very much limited in space, a smaller number of such conductors is desirable. Of course, this also holds true in order to simplify the driving logic circuit. Attempts to reduce the number of segments by using curvilinear segments in part have been made, but this has often tended to make the displayed numerals less legible.

SUMMARY OF THE INVENTION

The present invention proposes an arrangement of segments in a numerical display element which permits the number of the segments to be reduced without making the displayed numerals less legible and which is particularly suitable for use with cameras.

According to the present invention, a numerical display element comprising seven segments is provided in which the horizontally extending central segment of the seven segments is divided into two parallel segments, one end of each of which is connected to an adjacent discrete segment. Thus, the numerical display element is formed by six segments.

Of these six segments, the two top and bottom horizontal segments are electrically connected so that they are turned on or off simultaneously.

The invention will become more fully apparent from the following detailed description thereof when read in conjunction with the accompanying drawings.

BRIEF DESCRIPTION OF THE DRAWINGS

FIG. 2 is a driving logic table for the numerical display element of FIG. 1A.

FIG. 4 is a driving logic table for the numerical display element of FIG. 3A.

DESCRIPTION OF THE PREFERRED EMBODIMENTS

Before an embodiment of the present invention is described in detail, the prior art will be considered by reference to FIGS. 1 and 2 in order to make the present invention easier to understand.

Figure 1A:
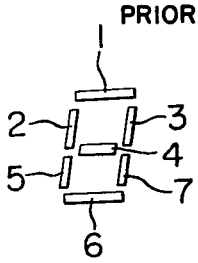
FIG. 1A PRIOR ART
FIGS. 1A and 1B are plan views showing the patterns of the numerical display element according to the prior art.
Figure 1B:
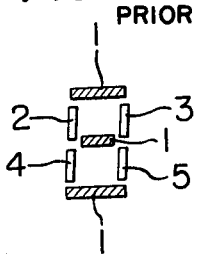
FIG. 1B PRIOR ART

FIGS. 1A and 1B show the known numerical display element which comprises seven segments, and FIG. 2 is a driving logic table indicating which segments are in ON state (represented as 1) and which segments are in OFF state (represented as 0) in order that numerals from 0 to 9 may be displayed by the element of FIGS. 1A and 1B. For example, in order that the numeral 4 may be displayed, it will be seen by laterally following the row 4 that segments 2, 3, 4 and 7 should be in ON state. This element has seven conductors led out of the segments, and in order to reduce this number of conductors, there has also been proposed a display element for camera which, as shown in FIG. 1B, substantially comprises five segments because the three horizontally extending segments are connected by a common conductor. Such element, however, cannot display the numeral 4 which is frequently used in the shutter time sequence or the aperture sequence of the camera which will hereinafter be described, and this leads to a disadvantage that an irregular sequence must be adopted.

Figure 3A:
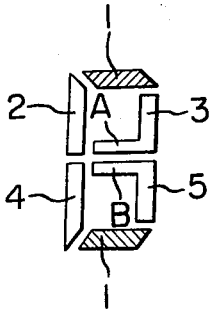
FIG. 3A is a plan view showing the pattern of the numerical display element according to an embodiment of the present invention.

According to the present invention, as shown in FIG. 3A, the central segment which corresponds to the segment 4 in FIG. 1A is divided into substantially parallel two segments A and B, which are at one end integrally connected to the segments 3 and 5, respectively. Thus, any and every numeral from 0 to 9 may be displayed by six segments. Further, in the present embodiment, the top and bottom segments 1 may be electrically connected together so that when one of them is in ON state the other also assumes ON state. Again with such an arrangement, any and every numeral from 0 to 9 may be displayed as will be clear from the driving logic table of FIG. 4. Moreover, the number of the conductors led out of these segments may be less by one, namely, five in all, which, as compared with the arrangement of FIG. 1A, means economy of the space required and simplification of the driving circuit for the same information display capacity. In such display element, the numeral 7 is displayed in a smaller size than the other numerals. In cameras, however, the shutter time sequence is 15, 8, 4, 2, 1, ½, ¼, ⅛, 1/15 1/30, 1/60, 1/125, 1/250, 1/500 and 1/1000 sec., while the aperture sequence is 1.0, 1.4, 2, 2.8, 4, 5.6, 8, 11, 16, 22, 32, 45, 64 . . . . Neither of these sequences includes the numeral 7 and no inconvenience will be encountered. This also holds true in a case where the display element of the present invention is used for the order of 10 seconds or 10 minutes in those timepieces wherein no numeral greater than 6 is displayed. Also, those of the numerals while appear with lower frequency may have their legibility somewhat sacrificed without any practical inconvenience being encountered.

Figure 3B:
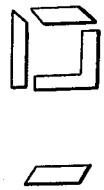
FIGS. 3B, 3C and 3D are plan views showing some examples of the pattern as displayed by the element of FIG. 3A.
Figure 3C:
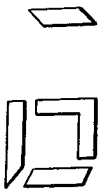
Figure 3D:
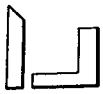

With the five-segment numerical display element of the present embodiment, any and every digit can be displayed and in addition, 0 is displayed in the manner as shown in FIG. 3B or 3C. Thus, the numeral 0 (zero) and the letter "o" (ou) representing overexposure can be distiguishably displayed as ⊡ or ⊡, and this may be said to be suited for cameras. Of course, the letter ⊔ representing underexposure can be displayed as shown in FIG. 3D.

The numerical display element of the present invention is sufficiently useful not only for cameras but also for timepieces. The present invention has the following advantages:

1. The reduced number of segments leads to a reduced number of conductors and a simplified driving circuit;
2. The information display capacity and the degree of legibility remain unchanged from the prior art; and
3. The invention is suitable for use with cameras when viewed from the frequencies and patterns of the appearing numerals, and is also useful for timepieces when viewed from the points (1) and (2) above.

I claim:

1. In a numerical display comprising seven segments, the improvement resides in that the horizontally extending central segment of said seven segments is divided into two parallel upper and lower segments connected to upper and lower right hand segments respectively to provide two substantially L-shaped segments, whereby said numerical display is formed by six segments.

2. A numerical display as defined in claim 1, wherein two top and bottom horizontal segments of said six segments are electrically connected so that they are turned on or off simultaneously.

* * * * *